US007722291B2

(12) United States Patent
McFarland

(10) Patent No.: US 7,722,291 B2
(45) **Date of Patent: *May 25, 2010**

(54) ADJUSTABLE BARRELING WAVE GENERATING APPARATUS AND METHOD

(76) Inventor: Bruce C. McFarland, 615 Marvista Dr., Solana Beach, CA (US) 92075

( * ) Notice: Subject to any disclaimer, the term of this patent is extended or adjusted under 35 U.S.C. 154(b) by 0 days.

This patent is subject to a terminal disclaimer.

(21) Appl. No.: 12/356,666

(22) Filed: Jan. 21, 2009

(65) Prior Publication Data

US 2009/0185863 A1 Jul. 23, 2009

Related U.S. Application Data

(60) Provisional application No. 61/022,680, filed on Jan. 22, 2008.

(51) Int. Cl.
*E02B 3/00* (2006.01)

(52) U.S. Cl. ..... 405/79; 472/128

(58) Field of Classification Search ..... 405/79; 472/128

See application file for complete search history.

(56) References Cited

U.S. PATENT DOCUMENTS 6,019,547 A * 2/2000 Hill ..... 405/79

OTHER PUBLICATIONS http://upload.wikimedia.org/wikipedia/commons/a/a1/F-117_Nighthawk_Front.jpg.*

* cited by examiner

*Primary Examiner*—David J Bagnell
*Assistant Examiner*—Sean D Andrish
(74) *Attorney, Agent, or Firm*—Manuel de la Cerra

(57) ABSTRACT

A wave forming apparatus has a channel for containing a flow of water, the channel having an inlet end connected to a water supply for supplying a flowing stream of water, a base, and spaced side walls, and at least one oblique foil member adjustably mounted in the base of the channel. The oblique foil member has a leading face extending at an oblique angle to the water stream in the channel, and a trailing, venturi face with a leading portion facing one of the side walls to form a venturi or constricted pass between the side wall and leading portion of the venturi face. The leading face, venturi face, and venturi pass together are adapted to form a standing barreling wave at the venturi pass. The orientation of the oblique foil member relative to the base of the channel is adjustable in order to vary the barreling wave formation, and may be adjusted during wave formation in order move the barreling wave across the leading face.

30 Claims, 9 Drawing Sheets

ADJUSTABLE BARRELING WAVE GENERATING APPARATUS AND METHOD

RELATED APPLICATION

The present application claims the benefit of co-pending U.S. provisional patent application No. 61/022,680 filed Jan. 22, 2008, which is incorporated herein by reference in its entirety.

BACKGROUND

1. Field of the Invention

The present invention relates generally to a wave forming apparatus for water rides or water features of the type provided in water-based amusement parks, water features in ornamental gardens, and the like, and is particularly concerned with an apparatus for forming a barreling wave, also known as a tubing or tunneling wave, which can support surfing activities or produce an attractive visual effect in a fountain or the like.

2. Related Art

Naturally occurring waves occur in the ocean and also in rivers. These waves are of various types, such as moving waves which may be of various shapes, including tubular and other breaking waves. Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. In some cases, the inclined surface is shaped to cause a tubular form wave. Sheet flow wave simulating devices have some disadvantages. For example, since these systems create a fast moving, thin sheet of water, they produce a different surfing experience to a real standing wave.

In other prior art wave forming devices, a wave is actually simulated in the water itself, rather than being defined by a surface over which a thin sheet of water flows. U.S. Pat. No. 6,019,547 of Hill describes a wave forming apparatus which attempts to simulate natural antidune formations in order to create waves. A water-shaping airfoil is disposed within a flume containing a flow of water, and a wave-forming ramp is positioned downstream of the airfoil structure. Apparatus for forming deep water standing waves is described in my prior U.S. Pat. Nos. 6,629,803 and 6,932,541. This apparatus creates waves that simulate natural standing waves. Use of an oblique bed form extending across the width of the channel or two intersecting water flows to create a barreling wave downstream of the standing wave is described in these patents.

SUMMARY

A wave forming apparatus has a channel for containing a flow of water, the channel having an inlet end connected to a water supply for supplying a flowing stream of water to the channel, a base, and spaced side walls, and at least one foil member adjustably mounted in the floor or base of the channel facing one of the side walls to form a venturi or constricted pass or throat between the side wall and foil, the foil member having a leading, substantially flat face extending at an oblique angle to the water stream in the channel and oriented at a pitch angle to the floor of the channel, and a trailing, venturi face opposing the channel side wall to form the venturi pass. In one embodiment, the foil member is pivotally mounted in the floor of the channel via a hinge or pivot mount so that it can be adjusted from an inoperative position where the leading face is flush with the floor of the channel to a selected pitch angle of the leading face. The pitch angle may be between 0 degree and 90 degrees to the floor of the channel, and in one embodiment is in the range of approximately 45 degrees to 90 degrees.

In one embodiment, an actuator such as a hydraulic actuator may be associated with the foil member in order to adjust the pitch angle of the leading face while the barreling wave is forming. This causes the barreling component of the wave to travel across the face of the foil member, producing a more realistic wave effect.

The combination of the oblique foil shape and opposing channel side wall together form a standing barrel wave which is like a river wave formed at a narrows. The part of the water stream which flows into the leading face of the oblique foil tends to rise up the tilted face and bend laterally towards the venturi pass. The part of the water stream which moves towards and up the venturi face and into the venturi pass combines with the deflected water from the leading face of the oblique foil, the two streams of water together forming a barreling wave in front of the venturi face and extending laterally into the venturi pass. After pitching out and forming the barrel, the water lands primarily in the venturi pass area on top of the primary stream of water through the pass.

In one embodiment, the top edge or peak of the oblique foil member is convex, and the foil may have a downwardly inclined trailing face, so that water flows freely over the peak of the foil member and back down to continue its flow along the channel. The venturi face of the foil member may curve back away from the opposing channel wall after the venturi pass. The height of the channel side walls is less than the height of the oblique foil in one embodiment, and below the peak of any wave formed in the venturi pass. This allows water to drain away from the venturi area Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an apparatus and method for forming waves in a water ride or water feature. For example, one method as disclosed herein allows for formation of an adjustable barreling or tubing wave which turns back at the peak to form a tube or tunnel and for adjustment of the barreling wave formation so that the wave travels.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
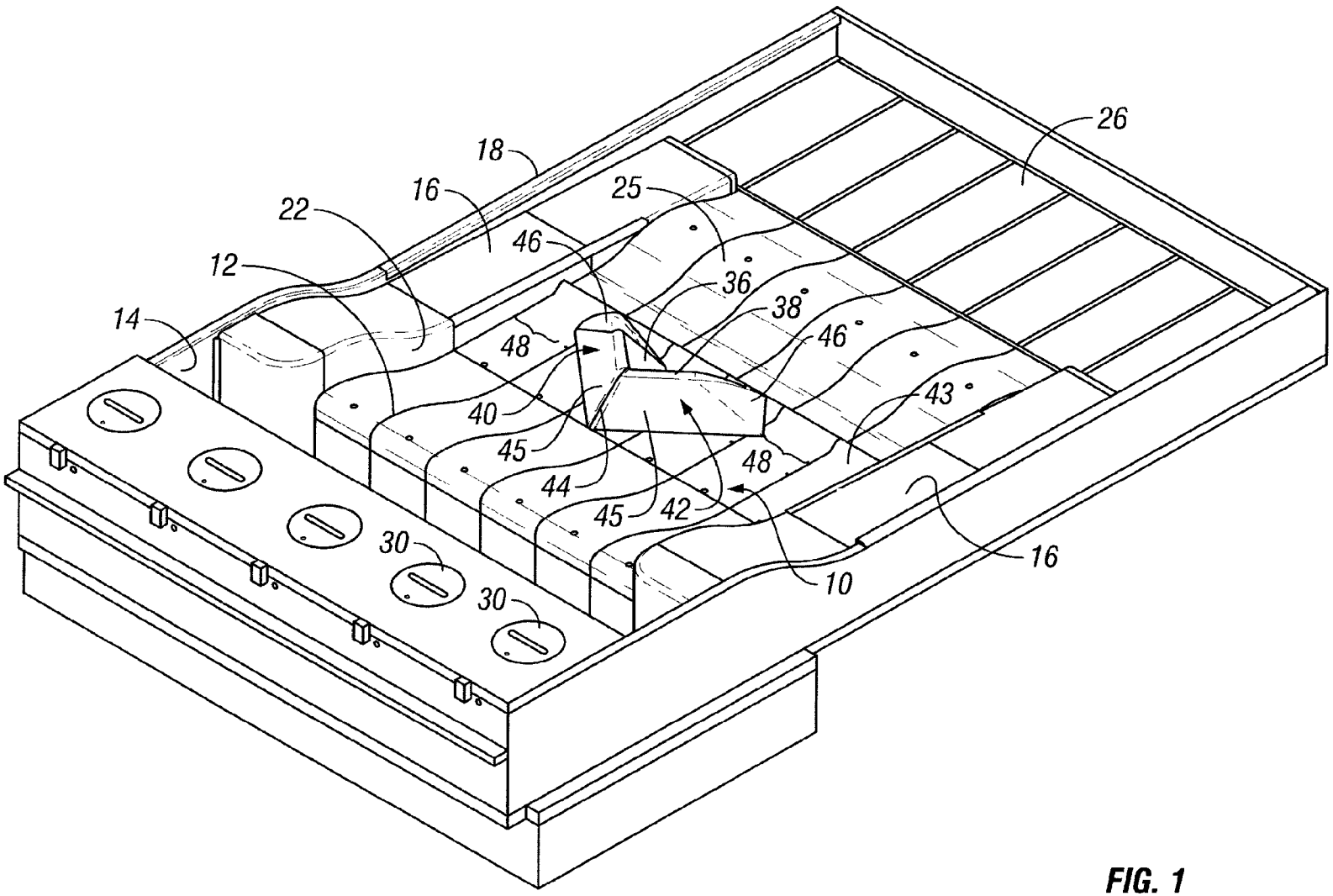
FIG. 1 is a perspective view of a wave forming apparatus of a first embodiment having a double barreling wave forming foil.

FIGS. 1, 2, 3A and 3B illustrate a first embodiment of a wave forming apparatus 100 designed to form barreling waves. The apparatus basically comprises a channel 10 for containing a flow of water, the channel having a weir 12 at its inlet end connected to a supply of water in a reservoir 14. Reservoir 14 has a smooth radius throat section guiding water over weir 12 and into the channel 10. River banks or entry/exit portions 16 extend outwardly from opposite side walls 22 of the wave forming channel 10 to the outer sides 18 of the apparatus, which are spaced outwardly from the outer sides of channel 10, as best illustrated in FIGS. 1 and 3. The outer side walls 18 may be eliminated in alternative embodiments. The river banks may be inclined downwardly at a small angle towards the trailing or exit end of the channel. Two barreling wave forming foils 40, 42 are mounted in the channel in a generally V-shaped formation with an apex 44 facing upstream. The foils 40, 42 face opposite side walls 22 of the channel at an oblique angle to the flow direction of water along the channel. Apart from foils 40, 42, the wave forming apparatus is similar to the apparatus described in my U.S. Pat. Nos. 6,629,803 and 6,932,541 and pending application Ser. No. 11/248,380 filed Oct. 11, 2005, and the contents of each of these documents are incorporated herein by reference.

Figure 2:
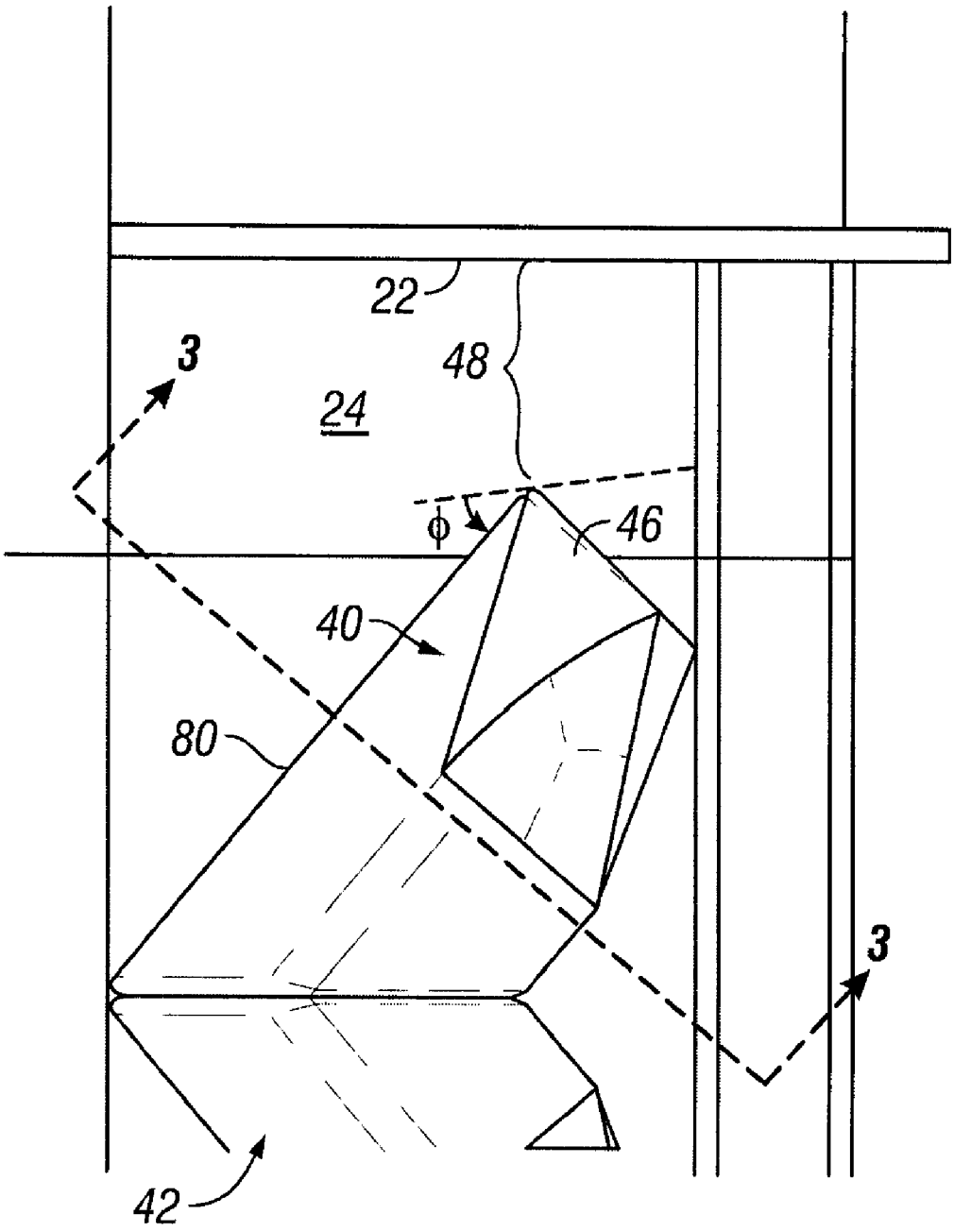
FIG. 2 is a top plan view, partly cut away, of the barreling wave forming foil of FIG. 1.

As best illustrated in FIGS. 2 and 3, the channel 10 has a base or lower wall 24 and the weir or alpha foil 12 is formed in the base wall at the inlet end of the channel so as to direct water from reservoir 14 into a flowing stream of relatively deep water along channel 10, as described in my prior patents and application referenced above. One or more bed forms or beta foils 25 for forming a standing wave may be located downstream of alpha foil 12 and oblique foils 40, 42, with a spoiler or small bump 43 in the floor prior to secondary or beta foil 25, but this is not essential and no additional foils may be provided downstream of oblique or barreling wave forming foils in other embodiments. A grating 26 or the like is provided at the outlet end of the channel in this embodiment, and water is returned via a passageway 28 extending under floor 24 and pumped by pumps 30 back into the reservoir 14. In an alternative embodiment, water could be returned by running out of the channel into a river or pool.

Although a weir or alpha foil is used in the illustrated embodiments to direct a stream of water along channel 10, in alternative embodiments the desired stream condition could be created with a tank and sluice gate or nozzle. The opposite side walls 22 of the channel may be straight, as illustrated, or may taper outwardly from the inlet end to the outlet end of the channel, and define a primary flow path for water through the channel.

Weir or alpha foil 12 curves downwardly from its peak to the base 24 of the channel. Oblique foils 40, 42 each have a base which is mounted in the base 24 of the channel, a generally flat or slightly convex, inclined leading face 45, a venturi face 46 extending from the leading face 45 and forming a venturi pass 48 with the adjacent side wall 22 of the channel, and a rear face 36. In the illustrated embodiment, each leading face 45 is at a sweep angle $\Phi$ of around 40 degrees to the direction of oncoming water flow in the channel, as best seen in FIG. 2.

Figure 3A:
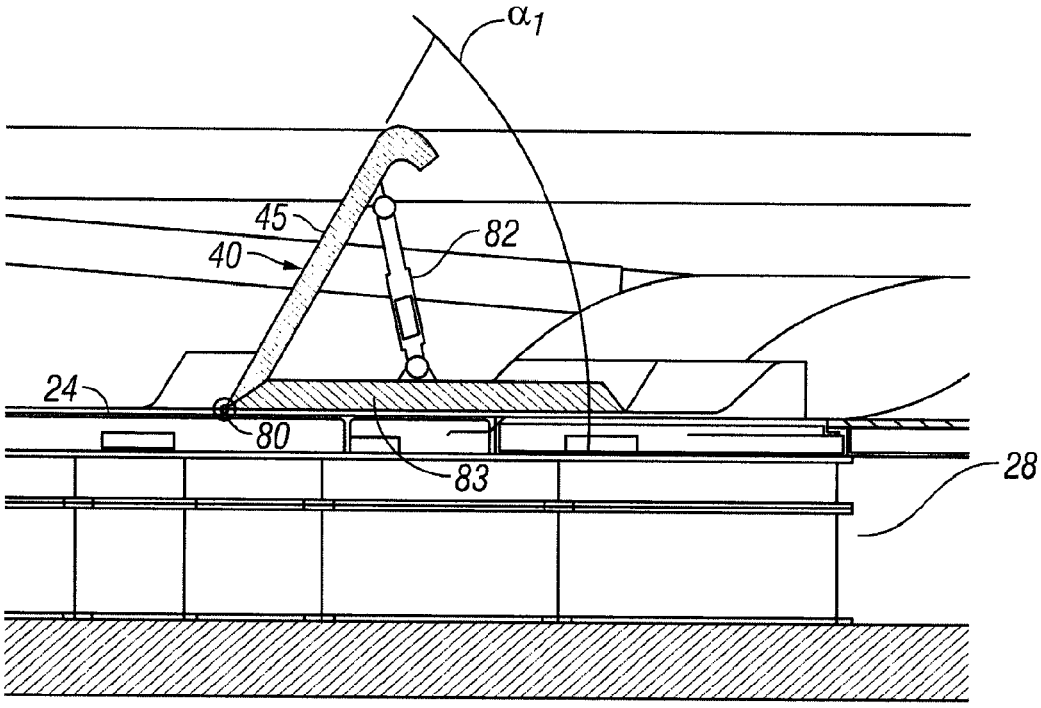
FIG. 3A is a cross sectional view on the lines 3-3 of FIG. 2, showing the leading face of the foil at a first pitch angle.
Figure 3B:
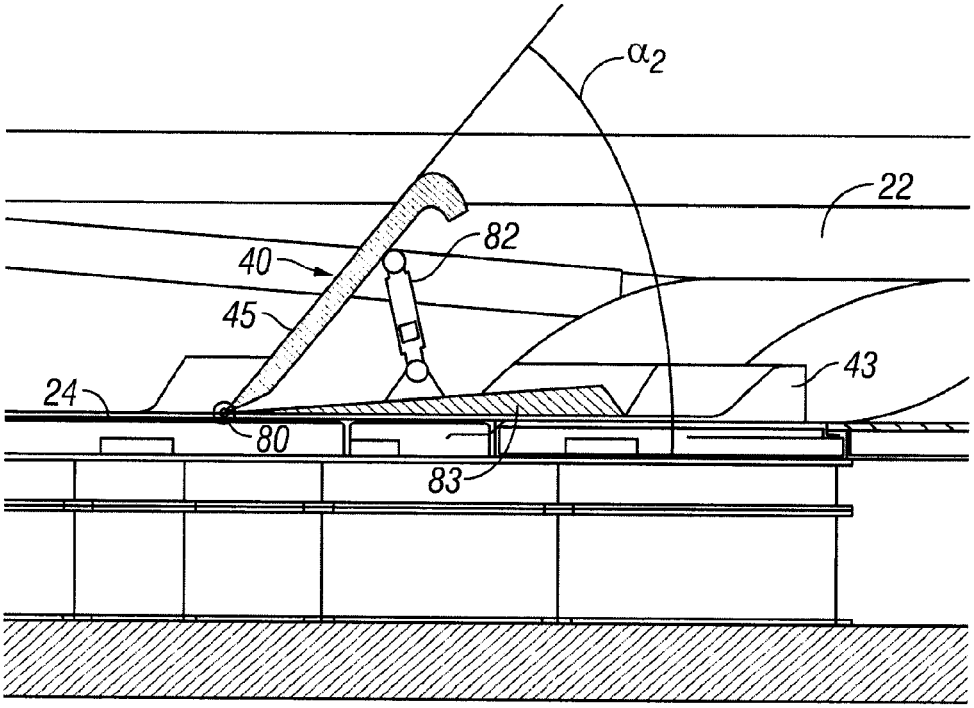
FIG. 3B is a cross sectional view similar to FIG. 3A, but showing the leading face of the foil at an adjusted, different pitch angle.

Leading face 45 is also inclined at an adjustable vertical tilt or pitch angle $\alpha$ relative to the floor 24 of the channel, as seen in FIGS. 3A and 3B. The arrangement and shape of the barreling wave forming foils 40, 42 is similar to the foils described in my co-pending application Ser. No. 11/550,239 filed Oct. 17, 2006 for a Barreling Wave Generating Device, the entire contents of which are incorporated herein by reference. In that application, one or more oblique or barreling wave forming foils are formed in the base of the channel or may be a modular component for securing in the base of the channel as desired. As stated in the prior application, the barreling wave forming foil or foils may be built flush in the flat tail portion extending from the alpha foil 12 and raised by means of actuators into the position shown in the drawings, or may be an inflatable device that can be raised and lowered. This allows the channel to be used to produce only a standing wave at beta foil 25, as described in my prior patents and pending application referenced above, or to be used to produce one or two standing barreling waves by raising one or both of the oblique foils 40, 42. In the prior application, foils 40, 42 positioned in a V-configuration were formed integrally or secured together at apex 44. In the embodiment of FIGS. 1 to 4, foils 40, 42 may be separate from one another to allow them to be adjusted independently, or may be secured together and adjusted with a single actuator.

Figure 4:
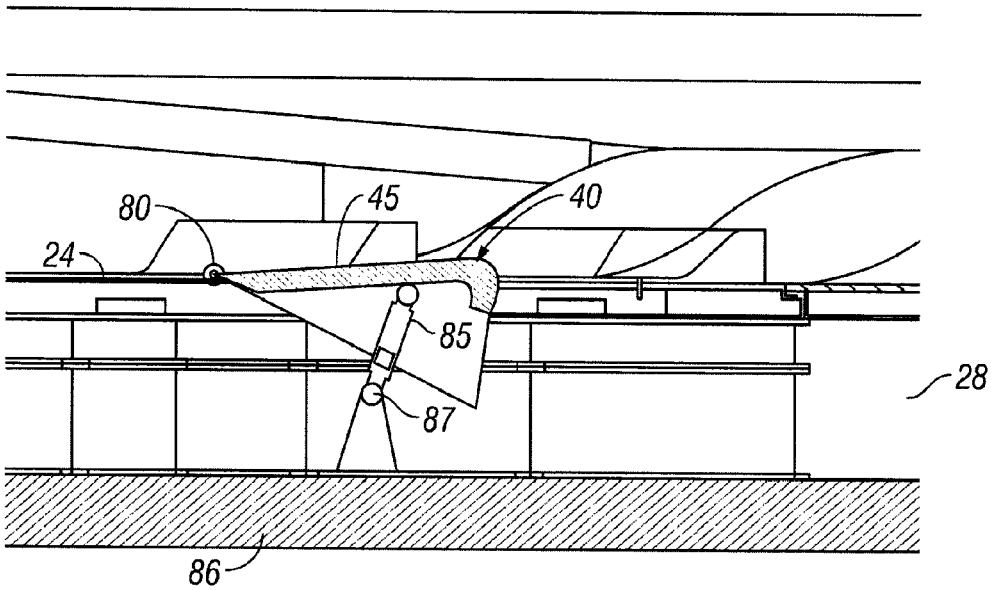
FIG. 4 is a cross sectional view similar to FIG. 3A but showing an alternative adjustment mechanism allowing the foil to be retracted substantially flush with the floor.

In this embodiment, as illustrated in FIGS. 2 and 3, each barreling wave forming foil 40, 42 is adjustably mounted in the base or floor 24 of the channel by a hinge or pivot 80 at its leading edge which faces the oncoming water flow in the channel, and one or more hydraulic or pneumatic ram actuators 82 or the like extends between an inner side of the front face 45 of the foil and a fixed base part 83 to allow the front face 45, or the entire foil, to be adjusted through a range of different pitch angles, including pitch angle $\alpha_1$ as illustrated in FIG. 3A and pitch angle $\alpha_2$ as illustrated in FIG. 3B. The adjustment can take place continuously so as to move a barreling wave across the front face 45, as described in more detail below. In the illustrated embodiment, angle $\alpha_1$ is around 70 degrees while angle $\alpha_2$ is around 30 degrees. The angular range provided by the adjustment mechanism may be in the range from 0 to 90 degrees in alternative embodiments. FIG. 4 illustrates an alternative adjustment mechanism which allows the adjustable foil 40 and 42 to be retracted into a position substantially flush with the base 24 of the channel. In this embodiment, a hydraulic or pneumatic actuator 85 is pivoted at one end on a pivot mount 87 in the bottom wall 86 of the passageway 28 beneath the floor of the channel and pivoted at the other end on an inner side of the front face or wall 40 of the foil. The foil is retracted down through an opening in the floor 24 when the actuator is fully retracted, as seen in FIG. 4, and tilts up through the opening as the actuator is extended.

The upper edge 38 of each foil 45 is convex or curved to reduce the risk of injury. The foil height in the illustrated embodiment is about equal to the height of the outer side walls 18 and greater than the height of channel side walls 22. This height difference is to ensure that at least part of a wave forming in the venturi pass is above the height of the channel walls, so that water can drain away from the venturi area and along the river banks 16 to avoid choking or backing up the flow. In one embodiment, the height of the channel wall 22 is around eleven inches below the peak 38 of the foil, and the channel wall height is around 30 inches. These dimensions are suitable for a 2.5 foot wave, but may be scaled up or down in alternative embodiments, depending on the overall size of the wave forming apparatus. The trailing or rear face 36 is also generally flat and inclined downwardly.

The venturi face 46 starts off facing the opposing channel side wall 22 and has a convex curvature leading from the trailing end of the relatively flat leading face 45, then curves rearwardly back towards trailing or rear face 36 and downwardly towards the base of the channel, as best illustrated in FIG. 1. Venturi face 46 has a curved apex which is rounded for safety to avoid a sharp corner, and also helps to reduce turbulence in the water flowing around the apex. The venturi pass 48 is defined between the leading, convex end of venturi face 46 and the opposing channel side wall, as indicated in FIG. 2. The leading end of face 46 is inclined away from the channel side wall in a direction upwardly from the floor at a "yaw" angle so that the venturi pass increases in width in a direction upwardly from the base of the channel, as best illustrated in FIG. 1. In the illustrated embodiment, the yaw angle is around 30 degrees, but this angle may range from 90 degrees to 20 degrees in alternative embodiments, dependent on the desired width of the venturi pass.

In this apparatus, an initial smooth and streamlined flow of relatively deep water enters the channel at foil 12. In one embodiment, the water velocity at the inlet end of the channel is around 12 feet per second while the water depth is around 0.7 feet. In alternative embodiments, the velocity may be in the range of around 8 to 25 fps, and the water depth may be in the range from 0.5 to 3.5 feet. Part of the water in the left hand half of the channel as viewed in FIG. 3 rises up the leading face 45 and bends laterally towards the venturi pass 48. The water moving over the leading face is of sufficient depth and velocity to support surfing maneuvers on various types of surfing equipment such as surfboards, bodyboards, and small kayaks known as playboats. At the same time, water moving towards the venturi face 46 of foil 40 or 42 combines with deflected water from leading face 45 to create a standing barreling wave in front of the leading face and venturi face extending laterally into the venturi pass 48. Riders can therefore ride in the barrel wave on a surfboard or bodyboard, where the apparatus is used as a water park attraction or ride. Alternatively, the apparatus on a smaller scale can be used for a visual or ornamental water feature (like a fountain) in parks, gardens, and other locations. The opposing channel wall 22 contains some of the water and allows some to spill onto the river bank 16 and run downstream to the grating or drain.

As described above, the leading surface 45 of each foil in this embodiment is hinged about the leading edge via hinge 80 at a pitch angle which can be varied by changing the extension of actuator 82. The actuator 82 can be a manual active adjuster that changes the pitch angle of the face, or may be adjusted automatically by a control system in order to vary the barreling wave formation in a desired manner. The effect of this angle change is to change the shape of the standing barreling wave. If the angle $\alpha$ is increased, the barreling area of the wave advances along the face of the foil, parallel to the hinge in a direction away from the venturi area. This produces the visual and functional effect of a naturally occurring ocean wave that is peeling as it travels. In this case it is a standing wave that peels across limited to the width of the stream. The effect is reversed by reducing the pitch angle. The rider has the advantage of a dynamic characteristic more closely simulating ocean surfing.

The practical angles of adjustment include the range from 0 (flat) to 90 (vertical) degrees. When flat, the foil is not functional, preventing any oblique wave from forming. As the angle increases, the stream redirected by the foil begins to interact with the foil and venturi to produce an oblique wave. At an optimum angle, which may be around 45 to 55 degrees, a hollow barreling section is formed. As the angle increases past optimum, for example in the range from around 55 degrees to 65 degrees, the barrel advances across the leading face 45 as described, until the wave ultimately collapses and the stream becomes overly obstructed by the foil face. As the angle is decreased from 65 degrees, the wave moves back in the opposite direction. By suitable control of the pitch angle, a barreling wave can be formed and caused to move back and forth across the barreling wave forming foil as a rider is surfing in the wave, producing a more natural effect and a longer ride.

The stream or flow rate of water arriving at the venturi pass is related to the size of the barreling wave formed at the pass. The faster the incoming rate, the bigger the wave. The venturi pass 48 and venturi face 46 are shaped to impede the flow of water so that the barrel is supported by deeper water through the pass. If the pass is too constricted, the barrel wave drowns and collapses. If the pass is not restricted enough, the barrel is smaller or non-existent, although there is still a surfable wave face in front of the foil 40 or 42. The venturi face is positioned close enough to the channel side wall 22 for the water flow to be impeded sufficiently to form a standing barreling wave. In the illustrated embodiment, the width of the venturi pass at the base of the channel is of the order of 37 inches and the overall channel width is around 20 feet. The venturi pass width is varied depending on the size of the channel and foil and the water stream rate characteristics. In general, the venturi pass width is approximately the same as the height of foil 20, and the maximum height of the foil is approximately the same as the desired wave height.

On arriving at the venturi pass 48, the water transitions from its initial shallower, higher speed condition ahead of leading edge of venturi face 45 to a substantially deeper stream above the venturi face and into the venturi pass. After pitching out and forming the barrel, the water lands primarily in the venturi pass area on top of the primary stream. This is a safety advantage, since riders can land in water. The primary stream serves to force the low energy water continuously through the venturi pass and over beta foil 25.

As noted above, the peak or top of the oblique foil is convex, and the peak and inclined downstream or rear face 36 of the foil allow water to stream freely over the foil in this area. The foil peak and downstream foil trailing surface 36 together allow a relatively smooth and safe transition for riders down into the downstream portion of the channel. Although the leading face of the foil has an abrupt or angled intersection with the floor 24 of the channel, as seen in FIG. 2, it may alternatively be smoothly blended into the floor at the pivot connection 80 for a smooth, curved transition from floor to foil.

The river banks 16 allow drainage around the foils 40, 42 without allowing water to leave the outer containment walls, and also allow for entry and exit of the ride. The channel may alternatively be made wider and deeper, but this is not practical for entry and might require more water flow and expense to operate.

In the embodiment illustrated in FIGS. 3A and 3B, each barreling wave forming foil 40, 42, or the front face of the foil, is designed to pivot through a selected range of angles of around 30 degrees to 70 degrees. In an alternative embodiment, as illustrated in FIG. 4, the entire foil is designed to pivot between a position flush with the floor 24 and a position in which the front face is at a desired maximum angle, which may be substantially vertical. In this case, sliding floor sections may be actuated to ensure that there are no gaps in the floor between the opening into which the foil retracts and the flush portions of the foil. In another alternative embodiment, the rigid, hinged foil with actuator 82 may be replaced by an inflatable foil of similar shape when fully inflated, along with a pressurized fluid supply which supplies fluid such as pressurized gas or a liquid to the foil for inflation purposes, and the foil may be designed to be inflated in sections to provide different leading face pitch angles.

Figure 5:
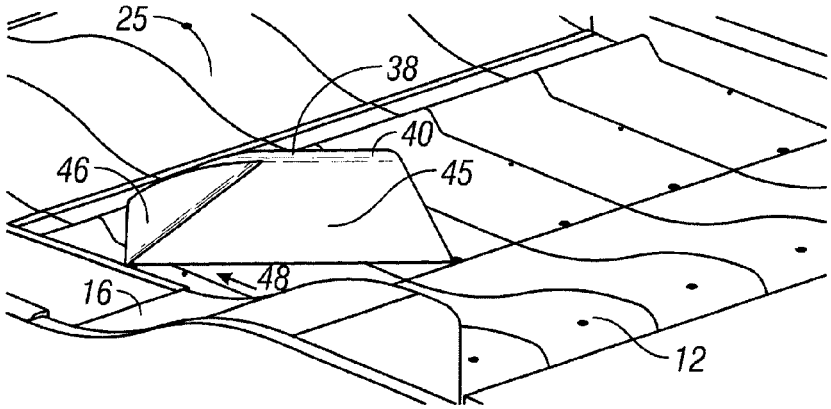
FIG. 5 is a perspective view of part of the channel of a wave forming apparatus similar to FIG. 1 but with a single barreling wave forming foil.
Figure 6:
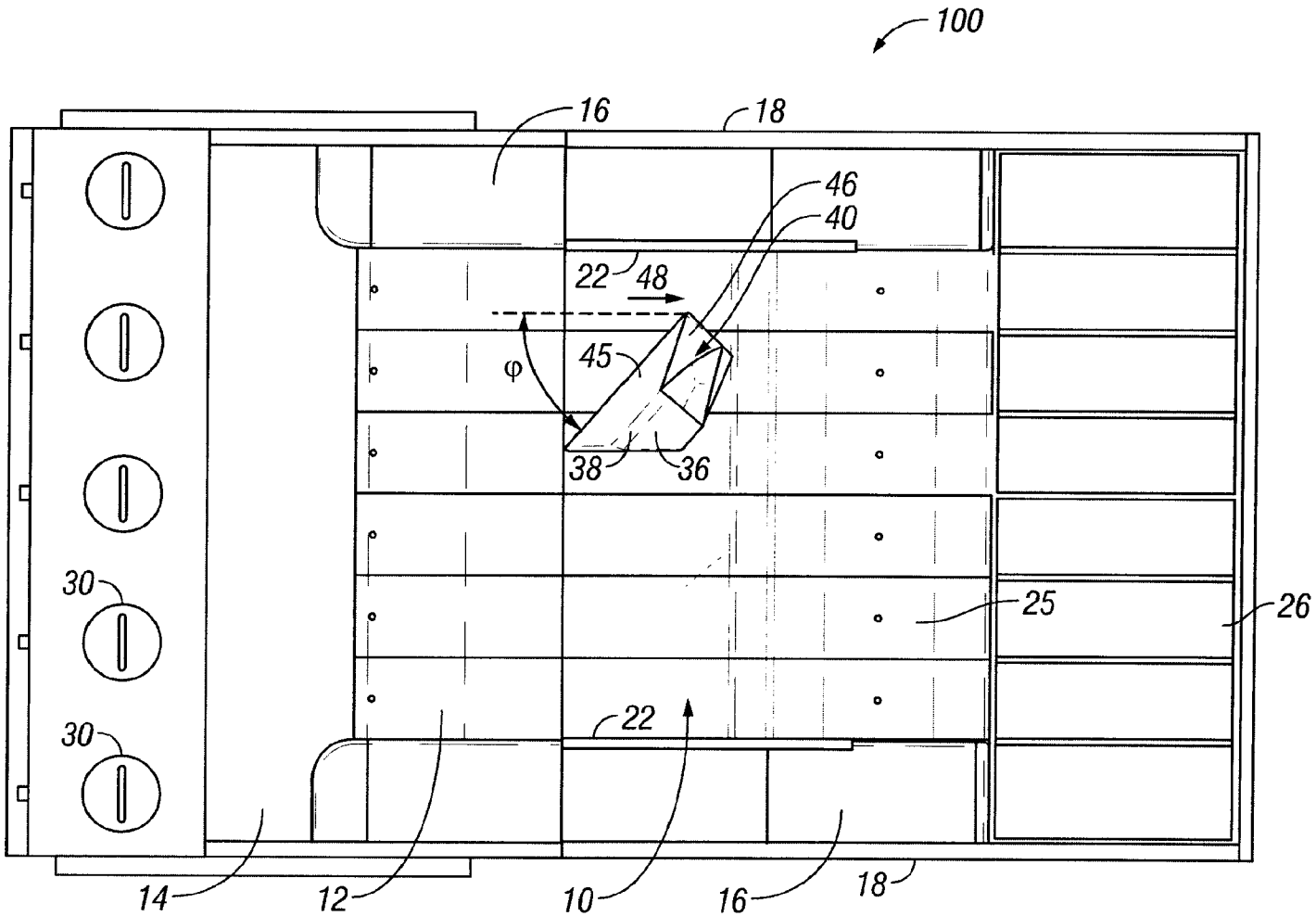
FIG. 6 is a top plan view of the apparatus of FIG. 5 which has a single barreling wave forming foil in one half of the channel.

In the embodiment of FIGS. 1 to 3, two barreling wave forming foils 40, 42 are provided in a V-configuration to produce barreling waves on each side of the channel. In an alternative embodiment, as illustrated in FIGS. 5 and 6, only one barreling wave forming foil 40 is provided on one side of the channel. This foil is exactly the same as one of the foils in the previous embodiment and is adjustable in the same manner to vary the pitch angle of the leading face 45, and like reference numbers are used for like parts as appropriate. In this embodiment, the foil 40 and venturi pass take up half or less than half of the width of the channel. Another type of wave may be formed in the other half of the channel, such as a wave of the type formed by shaped bed forms in the channel, as described in my prior patents and application referenced above.

Figure 7:
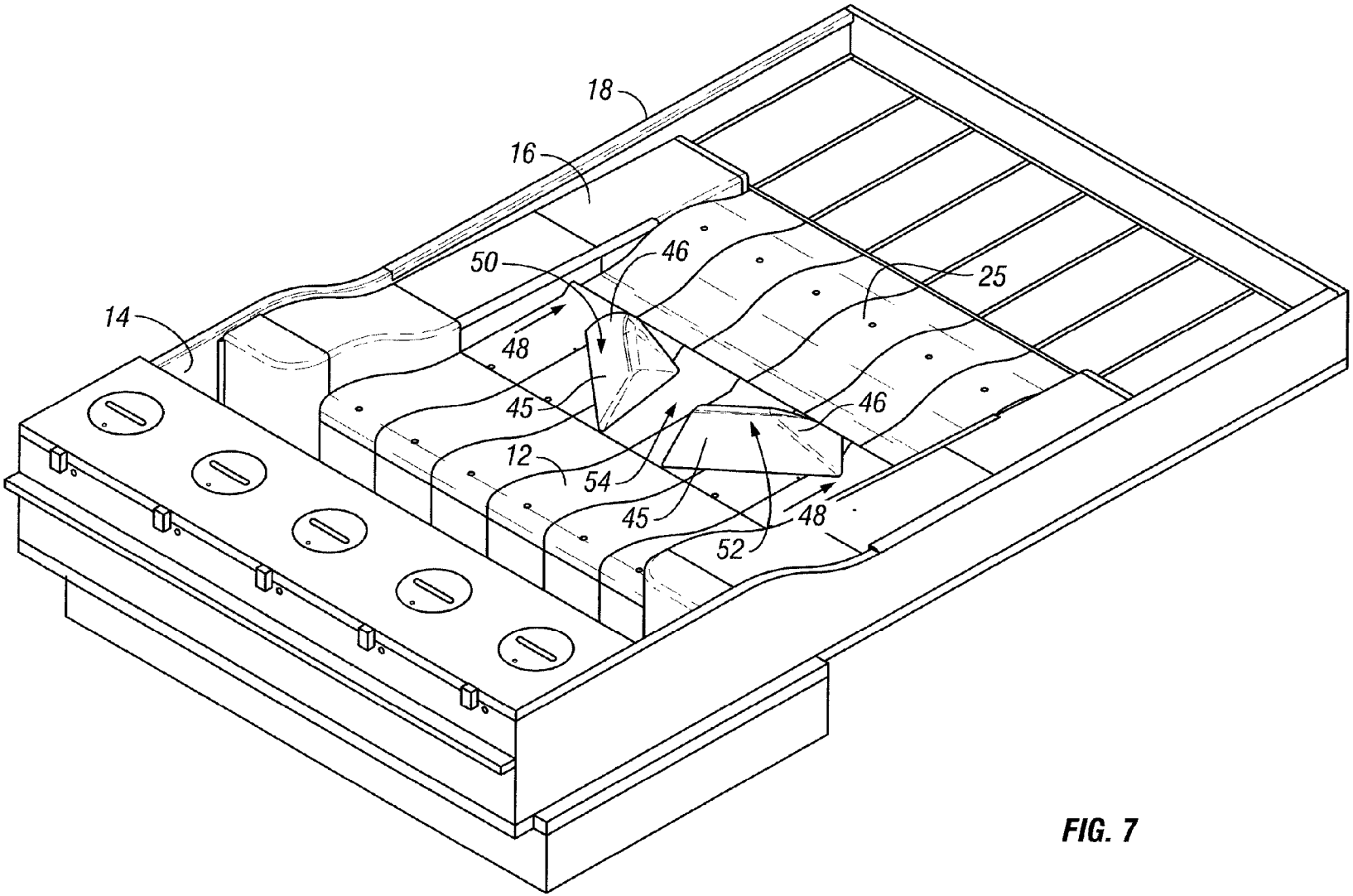
FIG. 7 is a perspective view of a wave forming apparatus of another embodiment having two separate barreling wave forming foils mounted in the channel.

FIG. 7 illustrates another embodiment which is similar to that of FIGS. 1 to 3 in that two barreling wave forming foils 50, 52 are used, but the foils in this case are separate, with a pass 54 formed along the center of the channel 10 between the foils. This apparatus is otherwise identical to that of the previous embodiments, and like reference numbers have been used for like parts as appropriate. As in FIGS. 1 to 3, each foil 50, 52 has a generally flat, inclined leading face 45 and a rearwardly curved venturi face 46 leading from the trailing end of the leading face and defining a venturi pass 48 between the leading edge of face 46 and the opposing channel side wall 22. Also as in the previous embodiments, each barreling wave forming foil is adjustably mounted in the base of the channel at its leading edge via a pivot mount and can be tilted up and down to vary the pitch angle and move the barreling wave across the face of the foil.

In each of the above embodiments, the barreling wave forming foils may be separate modules having bases adapted for mounting in the channel with suitable actuators for varying the pitch angle as desired, for example using an actuator 82 as illustrated in FIGS. 3A and 3B or an actuator 85 as illustrated in FIG. 4. They may be designed to tilt back flush into the base of the channel and raised into position by actuators when a barreling wave action is desired, and they may be pivoted up and down through a range of pitch angles so as to vary or move the barreling wave. The foil or foils may be rigid devices as shown or may be hollow, inflatable devices that can be inflated or deflated as desired by a ride operator. If the latter, separate wedge-shaped sections may be pivoted at their vertices and inflated in sequence to produce different pitch angles.

In the embodiment of FIG. 7, as in the first embodiment, two separate standing barreling waves are formed, one at each venturi pass 48. The pass 54 between the foils in FIG. 7 improves stream conditions downstream and behind the foils 50, 52 and also helps to separate riders if necessary.

Figure 8:
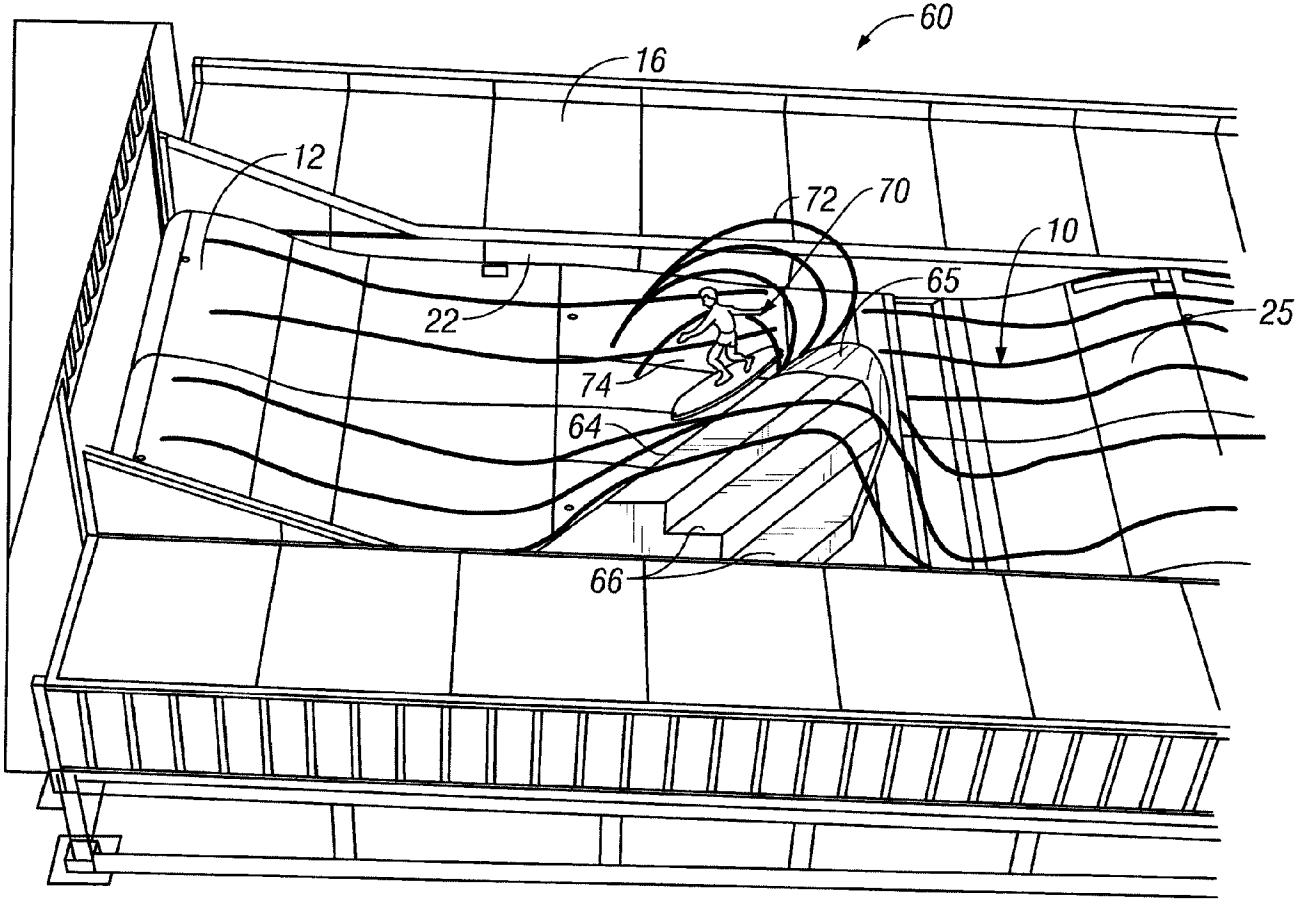
FIG. 8 is a perspective view of a wave forming apparatus of another embodiment having a single barreling wave forming foil mounted across a larger portion of the width of the channel, schematically illustrating formation of a barreling wave.

FIG. 8 illustrates a wave forming apparatus 60 of another embodiment which has an oblique or barreling wave generating foil 62 which extends across a larger portion of the channel 10 than in the previous embodiments. In this embodiment, a single barreling wave generating foil and venturi gap span the entire width of the channel, rather than only around half of the channel as in the previous embodiments, and the shape of the rear wall of the foil is modified. The remainder of the apparatus in FIG. 8 is the same as in the previous embodiments, and like reference numerals have been used for like parts as appropriate. As in the previous embodiments, the larger barreling wave generating foil 60 can be pivotally mounted in the base of the channel at its forward edge so that the pitch angle of the leading face 64 can be adjusted throughout the barreling wave formation, as described above in connection with the first embodiment. This embodiment is more appropriate for a dedicated barreling wave machine, whereas the previous embodiments are appropriate for a channel in which a barreling wave is one of several water attractions or rideable waves.

As in the previous embodiments, foil 62 is mounted in the base 24 of the channel downstream of alpha foil or weir 12. Foil 62 extends from one side wall 22 across the channel at an oblique angle to the water flow direction. Foil 62 has a generally flat, inclined leading face 64 and venturi face 65 extending from the leading face, as in the previous embodiments. However, the trailing or rear face of the foil is modified. The trailing face is formed with a series of steps 66 leading up to the peak 68 of foil 62. These steps can be used as a possible entry point for the ride.

The shapes and angles of the leading and venturi faces 64, 65 in this embodiment are the same as in the previous embodiments, with the leading face 64 inclined both to the flow direction and the base of the channel. The venturi face is convex and the leading edge or portion forms a venturi pass 70 with the adjacent, opposing side wall 22 of the channel. Venturi face 65 then curves back away from the side wall, as in the previous embodiments.

Figure 9:
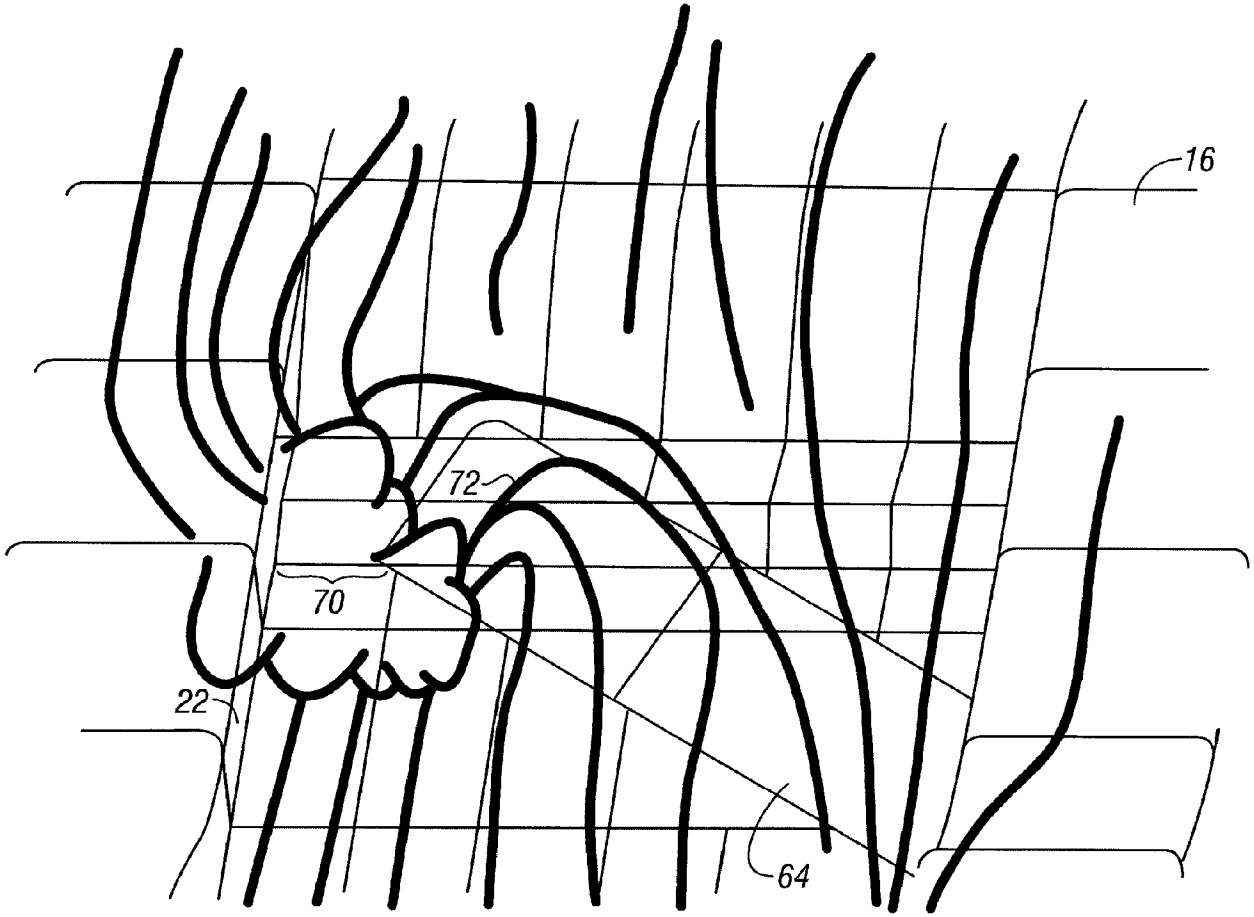
FIG. 9 is a perspective view of part of the channel in FIG. 8, taken from a different direction, showing the front face of the foil at a first pitch angle and schematically illustrating the location of the barreling wave.
Figure 10:
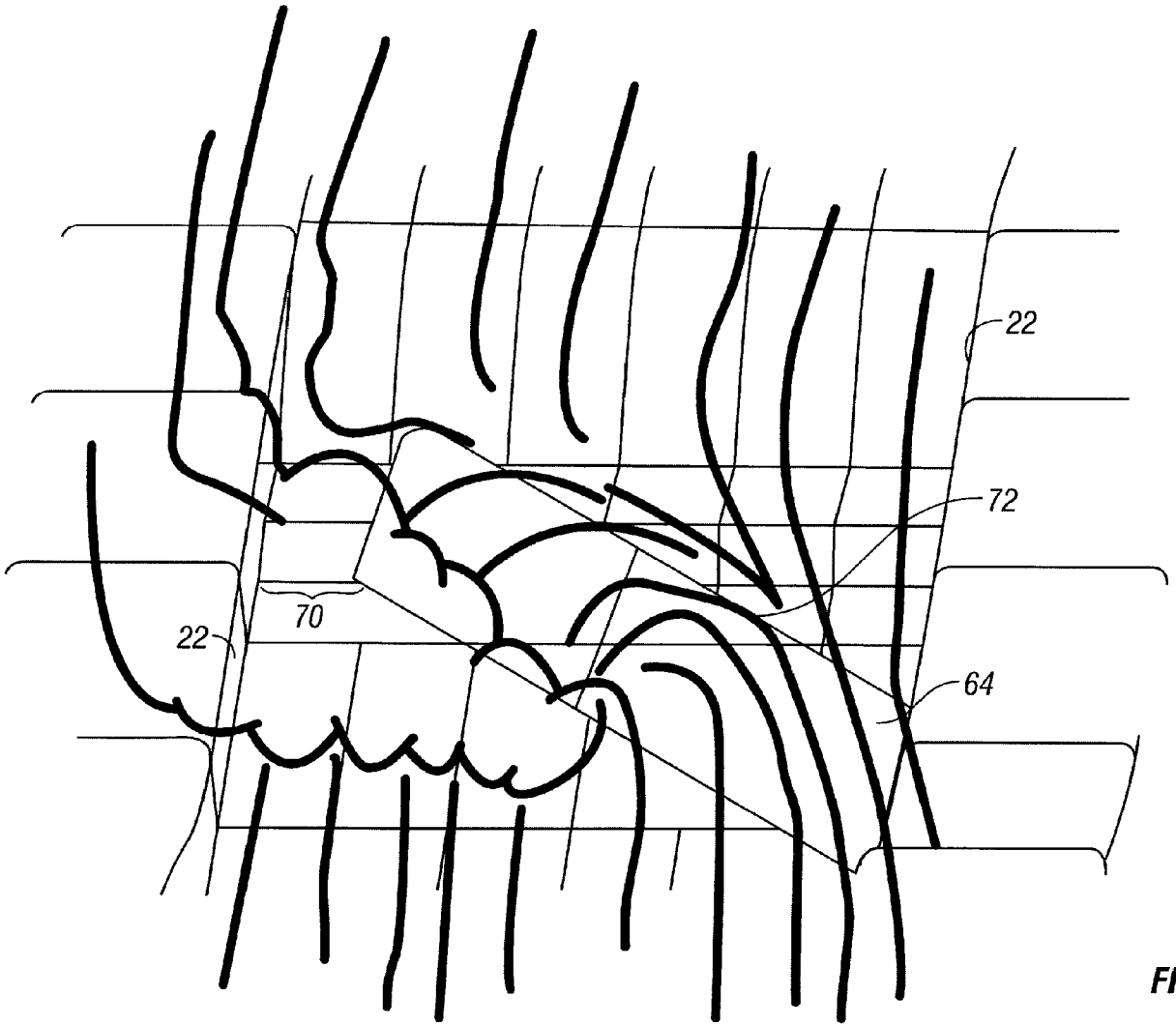
FIG. 10 is a view similar to FIG. 9 showing the front face of the foil at a different pitch angle and schematically illustrating the movement of the barreling wave when the foil angle is changed between the orientation of FIG. 9 and that of FIG. 10.

FIG. 8 schematically illustrates the water flow through channel 10, as indicated by the darker lines. As can be seen, water flowing on the right hand side of the channel as viewed from alpha foil 12 flows up and over the leading face 64 of the foil. Water moving towards the venturi face 65 of foil 62 in the left hand part of the channel combines with deflected water from leading face 64 to create a standing barreling wave 72 in front of the venturi face extending laterally into the venturi pass 70. FIG. 8 illustrates surfer 74 riding in the wave. The opposing channel wall 22 contains some of the water and allows some to spill onto the river bank 16 and run downstream to the grating or drain. Water also spills off the leading face of the foil onto the other river bank 16. Alternatively, the channel wall on this side could be raised to prevent spilling, or the foil could be extended widthwise over the inner channel side wall and onto the river bank to prevent water spilling on this side. Adjustment of the pitch angle of leading face 64 moves the barreling wave 72 back and forth across face 64 to produce a more natural appearance and ride. FIGS. 9 and 10 schematically illustrate the different positions of the barreling wave 72 when the angle of face 64 is adjusted. FIG. 9 illustrates the location of barreling wave 72 when the face 64 is at an angle of around 55 degrees, while FIG. 10 illustrates that the wave 72 has moved across face 64 to the right when the angle is increased to around 70 degrees.

The apparatus illustrated in each of the above embodiments may be scaled up or down depending on the type of water attraction desired. At a smaller scale it is suitable for inner tubing rather than surfing, and at an even smaller scale it may be used for a visual, fountain-like water feature rather than a ride. Larger scales of the apparatus may be used for surfing sports parks and events.

The outer side walls 18 in any of the above embodiments could be eliminated so that water could flow off opposite sides of the apparatus, for example into an adjacent pool or river. In this case, the adjacent pool or river may be at or close to the same elevation as the river bank.

The standing barrel wave created by the above embodiments is like a river wave created at a narrows. The venturi gap simulates a narrows, with the shape of the leading face and venturi face of the barrel wave forming foil enhancing the formation of the standing wave. The tilting away of the leading end of the venturi face from the channel wall provides a bottom contour at which water piles up on top of the foil in a controlled way. The venturi pass dimensions together with the design of the venturi face impedes water flow and supports the barrel through the pass. The deflection of some of the water flow by the oblique angle and shape of the leading face of the foil creates streamlines with a lateral velocity component towards the venturi gap which collide with streamlines flowing substantially downstream into the venturi pass zone, creating a wave shaped face and a barreling section in the venturi pass. Adjustment of the angle of the leading face causes the barreling wave to move across the face and this can take place while a rider is riding in the barrel. At the same time, excess water is allowed to spill out onto the adjacent river bank and run downstream.

The combination of the oblique foil shape and opposing channel side wall together form a standing barrel wave which is like a river wave formed at a narrows. The part of the water stream which flows into the leading face of the oblique foil tends to rise up the tilted face and bend laterally towards the venturi pass. The part of the water stream which moves towards and up the venturi face and into the venturi pass combines with the deflected water from the leading face of the oblique foil, the two streams of water together forming a barreling wave in front of the venturi face and extending laterally into the venturi pass. After pitching out and forming the barrel, the water lands primarily in the venturi pass area on top of the primary stream of water through the pass.

By locating the barreling wave generating foil upstream of a spoiler and bed form designed to create a standing wave, two or more different waves may be created in the channel under some flow conditions, or the barreling wave forming foil or foils may be retracted into the floor when only a standing wave is desired. Where there are two separate barreling wave forming foils, only one may be deployed so that a barreling wave is formed in one half of the channel with a standing wave downstream extending across at least the other half of the channel. Alternatively, both foils 40, 42 may be deployed simultaneously or alternately, and may be at different angles to create different barreling wave effects. This allows for a number of different wave variations to increase participants' interest in the ride.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A barreling wave generating apparatus, comprising:

a channel having an inlet end, a base, and opposite first and second side walls;

a water supply at the inlet end of the channel which supplies a flowing stream of water to the channel;

at least one foil member having a predetermined maximum height adjustably mounted in the base of the channel;

the foil member having a leading face extending towards the first side wall of the channel at an oblique angle to the flowing stream of the water and oriented at an adjustable pitch angle to the base of the channel, the leading face having a leading end and a trailing end in the flow direction, and a venturi face extending from the trailing end of the leading face and facing the first side wall to define a venturi pass between the first side wall and foil member wherein the width of the venturi pass is approximately equal to the foil member height;

the leading face, venturi face, and venturi pass together being adapted to form a barreling wave; and an adjustment device which adjusts the pitch angle of the leading face of the foil member relative to the base of the channel to control travel of the barreling wave across the foil member.

2. The apparatus of claim 1, wherein the pitch angle is adjustable through a range of 0 degrees to 90 degrees to the base of the channel.

3. The apparatus of claim 1, wherein pitch angle is adjustable through a range of angles between approximately 45 degrees and 90 degrees to the base of the channel.

4. The apparatus of claim 1, wherein the foil member is adjustable from a position substantially flush with the base of the channel through a range of raised positions at different pitch angles to the base of the channel.

5. The apparatus of claim 4, wherein the base of the channel has an opening and the foil member is pivotally mounted in the opening, the adjustment mechanism pivoting the foil member between an inoperative position in which the leading face is located in the opening substantially flush with the base of the channel and a selected raised position in which the foil member projects upwardly through the opening with the leading face at a selected pitch angle to the base of the channel.

6. The apparatus of claim 1, wherein the leading portion of the venturi face is of rounded, convex shape.

7. The apparatus of claim 1, wherein the venturi face has a rounded trailing portion.

8. The apparatus of claim 1, wherein the venturi face has a leading portion which is inclined away from the first side wall at a predetermined tilt angle.

9. The apparatus of claim 8, further comprising first and second river banks extending along opposite sides of the channel, the first river bank extending outwardly from the first channel side wall and the second river bank extending outwardly from the second channel side wall.

10. The apparatus of claim 9, wherein the river banks are angled downwardly in the downstream direction from the inlet end of the channel.

11. The apparatus of claim 1, wherein the height of the first side wall is less than the height of the foil member.

12. The apparatus of claim 1, wherein the leading face of the foil member is inclined at a sweep angle relative to the water flow direction.

13. The apparatus of claim 12, wherein the sweep angle is approximately 40 degrees.

14. The apparatus of claim 1, wherein the foil member has a peak at the top of the leading face and a downstream face extending from the peak to the base of the channel.

15. The apparatus of claim 14, wherein the peak is of a convex, rounded shape.

16. The apparatus of claim 15, wherein the downstream face is downwardly inclined.

17. The apparatus of claim 15, wherein the downstream face is shaped to form steps.

18. The apparatus of claim 1, wherein the first foil member is located in a first half of the channel and a second foil member is adjustably mounted in a second half of the channel adjacent with the first foil member, the second foil member having a leading face extending towards the second side wall of the channel at an oblique angle to the flowing stream of the water and oriented at an adjustable second pitch angle to the base of the channel, the second leading face having a second leading end and a second trailing end in the water flow direction, and a second, trailing venturi face extending from the second trailing end of the second leading face and facing the second side wall to define a venturi pass between the second side wall and the second foil member, the second leading face, and the second venturi face of the second foil member and the second venturi pass together being adapted to form a second barreling wave, and a second adjustment mechanism which adjusts the second pitch angle of the second leading face of the second foil member relative to the base of the channel to control travel of the second barreling wave across the foil member.

19. The apparatus of claim 18, wherein the second foil member is a mirror image of the first foil member.

20. The apparatus of claim 19, wherein the leading ends of the first and second foil members are adjacent one another to form a generally V-shape with an apex facing upstream.

21. The apparatus of claim 19, wherein the foil member and the second foil member are positioned in transverse alignment at the same general location in the channel, and are spaced apart to form a gap between the foil members at a central location between the first and second side walls of the channel.

22. The apparatus of claim 1, wherein the foil member and venturi pass span the width of the channel between the first and second side walls.

23. The apparatus of claim 1, wherein the channel has a predetermined width and the foil member and venturi pass span a width no greater than half the channel width.

24. The apparatus of claim 1, wherein the foil member is adjustable into a retracted position beneath the base of the channel.

25. The apparatus of claim 1, further comprising a weir at the inlet end of the channel, the water supply having a supply outlet having a smooth radius throat section directing water over the weir.

26. The apparatus of claim 1, further comprising a raised bed form extending across the channel downstream of the foil member.

27. The apparatus of claim 26, further comprising a raised spoiler extending across the channel between the foil member and bed form.

28. The apparatus of claim 1, wherein the foil member is inflatable between an inoperative position beneath the base of the channel and operative positions extending above the base of the channel.

29. A method of forming a standing barreling wave, comprising:

positioning a foil member to project upwardly from a base of a channel to a predetermined maximum height with a leading face of the foil member at an oblique angle to a water stream direction defined by the channel and a venturi face at a predetermined spacing from a first channel side wall approximately equal to the foil member height to define a venturi pass between a leading portion of the venturi face and the channel side wall;

supplying a flowing stream of water to an inlet end of the channel towards the foil member;

deflecting part of the water stream arriving at the leading face of the foil member into a deflected stream directed towards the venturi pass;

combining the deflected stream of water with water flowing directly along the channel into the venturi pass to form a barreling wave; and adjusting a pitch angle of the leading face of the foil member relative to the base of the channel, whereby the barreling wave travels across the leading face of the foil member.

30. The method of claim 29, wherein the step of adjusting the pitch angle comprises increasing the pitch angle above a first predetermined angle at which a barreling wave is formed so that the barreling wave travels across the leading face away from the venturi pass, and subsequently decreasing the pitch angle so that the barreling wave travels back across the leading face towards the venturi pass.

* * * * *